United States Patent [19]

Irish et al.

[11] 4,377,539

[45] Mar. 22, 1983

[54] CARBURETOR AIR BLEED CONTROL

[75] Inventors: David C. Irish, Livonia; John G. Bathe, Jr., Taylor, both of Mich.

[73] Assignee: Ford Motor Company, Dearborn, Mich.

[21] Appl. No.: 343,669

[22] Filed: Jan. 28, 1982

[51] Int. Cl.[3] ..... F02M 7/24

[52] U.S. Cl. ..... 261/121 B; 261/DIG. 74

[58] Field of Search ..... 261/121 B, DIG. 74

[56] References Cited

U.S. PATENT DOCUMENTS

| | | | |
|---|---|---|---|
| 2,243,072 | 5/1941 | Abramson | 261/121 B |
| 2,395,554 | 2/1946 | Jones | 261/121 B |
| 3,548,792 | 12/1970 | Palmer et al. | 261/121 B |
| 3,789,702 | 2/1974 | Price | 261/121 B |
| 3,861,366 | 1/1975 | Masaki et al. | 261/121 B |
| 3,933,951 | 1/1976 | Fischer et al. | 261/121 B |
| 4,007,721 | 2/1977 | Regueiro | 261/121 B |
| 4,010,723 | 3/1977 | Suziki et al. | 261/121 B |
| 4,088,100 | 5/1978 | Tokura et al. | 261/DIG. 74 |
| 4,153,652 | 5/1979 | Ogita | 261/121 B |
| 4,187,814 | 2/1980 | Phelan et al. | 261/121 B |
| 4,201,166 | 5/1980 | Nishimura et al. | 261/121 B |
| 4,217,314 | 8/1980 | Pysarz | 261/121 B |

FOREIGN PATENT DOCUMENTS

| | | | |
|---|---|---|---|
| 53-37976 | 10/1978 | Japan | 261/121 B |
| 55-49559 | 10/1980 | Japan | 261/121 B |

*Primary Examiner*—Tim R. Miles

*Attorney, Agent, or Firm*—Robert E. McCollum; Clifford L. Sadler

[57] ABSTRACT

A carburetor is provided with an air bleed passage connected to the main fuel well; the passage being controlled by a solenoid opened, normally closed valve; the solenoid being electrically connected in series arrangement with a venturi vacuum actuated, normally closed switch and a wide open throttle (WOT), normally open switch closed by movement of the throttle valve to a wide open position, the electrical circuit being completed at low mass air flows, WOT operation to open the air bleed line and lean out the air/fuel ratio of the mixture charge; the electrical circuit being broken when venturi vacuum reaches a predetermined level indicating maximum horsepower will be better obtained by a richer air/fuel ratio.

3 Claims, 1 Drawing Figure

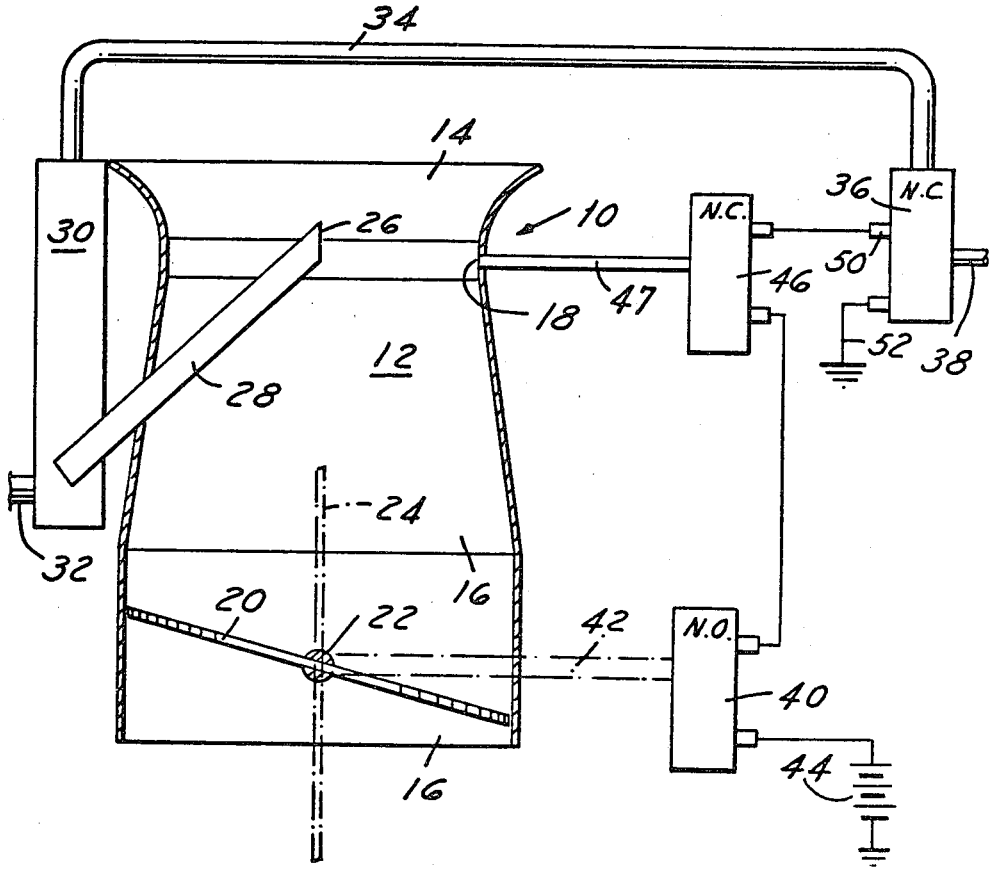
34
14
30
26
10
N.C.
36
N.C
50
46
47
18
52
38
12
28
24
32
16
20
22
42
N.O.
40
44
16

CARBURETOR AIR BLEED CONTROL

This invention relates in general to an automotive-type carburetor. More particularly, it relates to an air bleed system for controlling the flow of fuel through the carburetor.

It is a primary object of the invention to provide a carburetor with an air bleed control that is operable during low speed, wide open throttle conditions of operation to lean out the air/fuel mixture charge to reduce the output of undesirable emissions into the atmosphere, and operable at higher mass air flows to richen the air/fuel ratio of the mixture charge for obtaining maximum horsepower operation.

When the carburetor is operating at low speeds under wide open throttle conditions, the air flow volume through the induction passage initially is relatively low, which results in a richer air/fuel ratio to the charge than is necessary under these conditions. This richer ratio may result in the generation of higher levels of unburned hydrocarbons and carbon monoxide than are desirable.

This invention provides a construction that bleeds down the carburetor main fuel well vacuum signal to lean out the air/fuel ratio at lower air flows (rpms), while still providing enrichment at higher air flows to permit the engine to develop its maximum power. The system includes a number of electrical switches controlled in response to the position of the carburetor throttle valve and the volume of air flow through the carburetor to control the flow of bleed air into the fuel system.

It is known in the prior art to control carburetor air bleeds electromagnetically by means of solenoids, for example, and/or in response to movement of the carburetor throttle valve or in response to other operating parameters of the engine, to vary the air/fuel ratio in accordance with predetermined schedules. For example, U.S. Pat. No. 4,088,100, Tokura, shows an air bleed system for a carburetor in which an electromagnetically controlled valve 36 controls an air bleed 34 as a function of the position of a throttle valve 22. In this case, however, the air bleed is used only to maintain a predetermined air/fuel ratio and does not function to lean the air/fuel ratio at lower air flows, wide open throttle conditions of operation in the manner proposed by this invention.

U.S. Pat. No. 3,548,792, Palmer, is another example of an electromagnetically controlled air bleed system varying the air/fuel ratio of an engine as a function of engine parameters including the position of a throttle valve of the engine. FIG. 2 illustrates an air bleed valve movable with respect to the fuel system of the carburetor.

U.S. Pat. No. 3,861,366, Masaki et al, also shows an air bleed valve 33, as well as bleed valves 21 and 22 that are electromagnetically controlled to control the air/fuel ratio of the mixture as a function of the position of the throttle valve and other engine operating parameters.

The Palmer and Masaki devices, however, do not operate in the manner proposed by this invention. They do not lean out the air/fuel ratio during wide open throttle conditions at low air flows while closing the air bleed and richening the air/fuel mixture when the air flow increases beyond a predetermined level.

Other examples of devices having solenoid controlled air bleed valves are those to Price, U.S. Pat. No. 3,789,702, and Fisher et al., U.S. Pat. No. 3,933,951. Price shows a normally open air bleed that is closed in response to shifting of the transmission to delay the enrichening of the air/fuel mixture by the power valve circuit of the carburetor. Fisher et al shows a solenoid 121 that is operated to lean out the air/fuel ratio at certain times, while permitting enrichment of the ratio at other times. Neither Price nor Fisher et al, however, show switch means and valves like that of the invention to provide a lean air/fuel ratio during low speed, wide open throttle conditions of operation while permitting maximum power to be developed during high air flow conditions.

Other objects, features and advantages of the invention will become more apparent upon reference to the succeeding detailed description thereof, and to the drawing containing a single FIGURE schematically illustrating a carburetor embodying the invention.

The FIGURE illustrates schematically a portion 10 of a down-draft type carburetor for use with an automotive type internal combustion engine. The carburetor includes the usual air/fuel induction passage 12 open at its upper end 14 to air essentially at atmospheric pressure from the clean air side of an air cleaner, not shown. The lower end 16 of the carburetor is adapted to be connected to the intake manifold of the engine to be subject to the changing vacuum levels therein.

The carburetor contains the usual fixed area venturi 18, and may contain a booster venturi, not shown. At its lower end, the induction passage is closed by a throttle valve or plate 20 that is rotatably mounted in the carburetor side walls on a shaft 22. It rotates from the essentially closed full line position shown to the wide open or vertical position indicated in dotted lines at 24 to variably control the flow of the air/fuel mixture charge through the induction passage.

The induction passage 12 is supplied with fuel from a nozzle 26 that projects into the carburetor adjacent the venturi 18, the nozzle being connected by a tube 28 to a main fuel well 30. The latter is supplied with fuel from a conventional carburetor float bowl, not shown, through a connecting conduit 32 usually located in the lower portion of the float bowl.

Further details of construction of the carburetor per se, such as, for example, the idling system, are not given since they are known and believed to be unnecessary for an understanding of the invention. Suffice it to say, that opening of throttle valve 20 by rotation in a clockwise direction subjects induction passage 12 to the manifold vacuum of the engine and thereby induces an air flow into the passage. The flow of air past nozzle 26 will cause fuel to be inducted into the passage in an amount depending upon the volume and velocity of the air flow past the nozzle.

Turning now to the invention, the main fuel well is connected by an air bleed line 34 to an on-off type air bleed valve indicated schematically at 36. The latter has an air inlet 38 and is a normally closed (N.C.) valve, as indicated, to prevent the bleed of air into the main well. Valve 36 is adapted to be opened by a solenoid (not shown) attached to the valve when energized under certain conditions to be described.

The air bleed system contains a first normally open (N.O.) switch 40, hereinafter referred to as a wide open throttle (WOT) switch. The WOT switch is mechanically connected by a linkage indicated schematically at 42 to throttle valve shaft 22 so as to be mechanically moved from a normally open to a normally closed position in response to movement of the throttle valve 20 from the full line closed throttle position shown to the dotted line or wide open throttle position 24. The WOT switch 40 has a 12-volt power supply or electrical circuit input 44. The WOT switch is electrically connected in a series flow arrangement to the contacts of a second switch 46 that is normally closed (N.C.). Switch 46 is pressure opened in response to the venturi vacuum acting thereon in a line 47 connected to venturi 18 reaching a predetermined level. When opened, switch 46 breaks the electrical circuit from the 12-volt power supply 44 to the contacts 50 of the solenoid secured to valve 36, the circuit being grounded as indicated at 52.

In operation, with throttle valve 20 in the position indicated in full lines at closed or idle speed condition of operation, WOT switch 40 will be in its normally open condition breaking the circuit between the 12-volt power supply 44 and the venturi pressure switch 46. The solenoid of the normally closed valve 36, therefore, will not be energized, and the valve will remain closed. No air will be bled into the main well system. Accordingly, under idling conditions, the air/fuel mixture charge to the engine will be normal.

When rapid acceleration of the vehicle from the idle speed condition is demanded, movement of the throttle valve 20 from the solid to the dotted line position 24 will mechanically close the WOT switch 40 and complete the electrical circuit from the 12-volt power supply 44 to the venturi pressure switch 46. This switch being normally closed at low air flows, and the air flow through the carburetor at this time being at a low velocity insufficient to develop the venturi vacuum sufficient to change the position of switch 46, the electrical circuit will remain completed to the solenoid controlled air bleed valve 36. This latter valve, therefore, now opens and bleeds air from line 38 into line 34 to the main well, thereby decaying the vacuum signal acting on the fuel and thereby decreasing the flow of fuel from the nozzle 26.

When the mass air flow through induction passage 12 has increased to the changeover point where leaning out of the air/fuel mixture is no longer necessary and maximum power is desired, the venturi vacuum signal obtained at this time in line 47 will be sufficient to move pressure switch 46 to the open position to thereby break the electrical circuit from the 12-volt power supply 44 to the solenoid connected to bleed valve 36. This will permit the latter valve to close to its normal position and thereby terminate the decay of the fuel signal in the main well 30. Thereafter, the full fuel charge will be inducted through nozzle 26 into induction passage 12.

From the foregoing, it will be seen that the invention provides a simple and yet effective air bleed system to control the air/fuel mixture charge ratio at low speed, wide open throttle conditions of engine operation to reduce the production of unburned hydrocarbons and carbon monoxides while subsequently permitting a richening of the air/fuel ratio to provide maximum horsepower.

While the invention has been shown and described in its preferred embodiment, it will be clear to those skilled in the arts to which it pertains that many changes and modifications may be made thereto without departing from the scope of the invention. For example, it will be clear that the system is also adaptable to an electronically controlled air bleed system in which the air flow through the carburetor induction passage could be calculated by a speed density equation, and the changes in air flow communicated to the electronic control, which would then determine when the air bleed valve would open or close. Alternatively, a mass air flow meter could be used instead of the venturi vacuum actuated switch that would make a direct air flow measurement, which when communicated to the electronic control, would activate the air bleed valve solenoid at the wide open throttle, low air flow conditons.

We claim:

1. An air bleed control for a carburetor having an induction passage with a venturi formed therein and a throttle valve downstream thereof rotatably mounted for variable movement between closed and wide open positions, a fuel passage connected to the venturi for the induction of fuel thereinto, an air bleed passage operably connected to the fuel passage to at times bleed the venturi vacuum signal acting on the fuel to thereby decrease the flow of fuel, and control means responsive to the position of the throttle valve and the air flow through the induction passage to control the bleed of air into the air bleed passage, the control means including a normally closed solenoid operated open-close valve controlling the admission of air to the air bleed passage, a source of electrical energy, and a normally open throttle valve operated switch movable to a closed position upon movement of the throttle valve to a wide open throttle position to complete the circuit between the source and open-close valve to open the latter valve and bleed air into the fuel passage.

2. A control as in claim 1, including a pressure sensing port in the induction passage adjacent the venturi, and a normally closed venturi vacuum actuated switch connected to the port located in series flow circuit relationship with the bleed valve and the normally open switch to break the circuit between the throttle valve operated switch and the bleed valve solenoid in response to the attainment of a predetermined venturi vacuum level indicative of air flow through the carburetor.

3. An air bleed control for a carburetor having an induction passage with a venturi formed therein and a throttle valve downstream thereof rotatably mounted for variable movement between closed and wide open positions, a fuel passage connected to the venturi for the induction of fuel thereinto, an air bleed passage operably connected to the fuel passage to at times bleed the venturi vacuum signal acting on the fuel to thereby decrease the flow of fuel, and control means responsive to the position of the throttle valve and the air flow through the induction passage to control the bleed of air into the air bleed passage, the control means including an electrical circuit including a first switch movable by the throttle valve from a normally open circuit position to a closed circuit position upon movement of the throttle valve towards a wide open position, a second pressure actuated switch in series circuit arrangement with the first switch and movable in response to a predetermined rise in venturi vacuum level from a normally closed circuit position to an open circuit position, and a third normally closed electrically controlled valve downstream of the second switch and operable upon completion of the electrical circuit thereto to open to admit air to the air bleed passage.

* * * * *